United States Patent [19]

McNair, Jr.

[11] 4,221,198

[45] * Sep. 9, 1980

[54] INTERNAL COMBUSTION ENGINE WITH SUSTAINED POWER STROKE

[75] Inventor: Robert J. McNair, Jr., Cincinnati, Ohio

[73] Assignee: Avco Corporation, Cincinnati, Ohio

[ * ] Notice: The portion of the term of this patent subsequent to Sep. 18, 1996, has been disclaimed.

[21] Appl. No.: 948,729

[22] Filed: Oct. 5, 1978

Related U.S. Application Data

[63] Continuation-in-part of Ser. No. 927,214, Jul. 24, 1978, Pat. No. 4,167,930.

[51] Int. Cl.[3] ..... F02B 19/16

[52] U.S. Cl. ..... 123/285; 123/286; 123/572

[58] Field of Search ..... 123/32 E, 32 K, 32 L, 123/32 SP, 32 ST, 75 B, 22, 26, 75 B, 119 E, 119 EE, 191 B, 191 C, 191 SP, 198 A, DIG. 4

[56] References Cited

U.S. PATENT DOCUMENTS

| | | | |
|---|---|---|---|
| 3,987,776 | 10/1976 | Goto et al. | 123/DIG. 4 |
| 4,060,059 | 11/1977 | Bodine, Jr. | 123/32 ST |

*Primary Examiner*—Ronald H. Lazarus

*Attorney, Agent, or Firm*—Robert J. McNair, Jr.; Irwin P. Garfinkle

[57] ABSTRACT

A four stroke cycle internal combustion engine is presented having a sustained power stroke which results from a delayed mixing of a stratified charge. Use of delayed mixing of an overall stoichiometric air-fuel mixture results in formation of a low amount of the oxides of nitrogen. Delayed mixing of the stratified charge is achieved by placement of at least one Helmholtz resonator cavity in the head or closed end of each combustion chamber. The Helmholtz resonator cavity communicates with the top end of the main combustion chamber via a narrow slot. On the intake stroke of each engine cylinder, the main chamber is filled with a slightly fuel rich gaseous charge while the companion Helmholtz resonator cavity is filled with air. During the compression stroke some of the rich air-fuel mixture is forced into the resonator cavity via the communicating slot. At or near TDC, the air-fuel mixture in the main chamber is ignited. As the flame front progresses across the chamber a rapid increase in pressure serves not only to power the piston, but also to initiate a resonant reaction in the Helmholtz resonator cavity which results in a transfer of the unburned gases therein into the main combustion chamber. This both sustains the power stroke and at the same time lowers the peak flame temperature in the main chamber.

8 Claims, 4 Drawing Figures

INTERNAL COMBUSTION ENGINE WITH SUSTAINED POWER STROKE

BACKGROUND OF THE INVENTION

Figure 1:
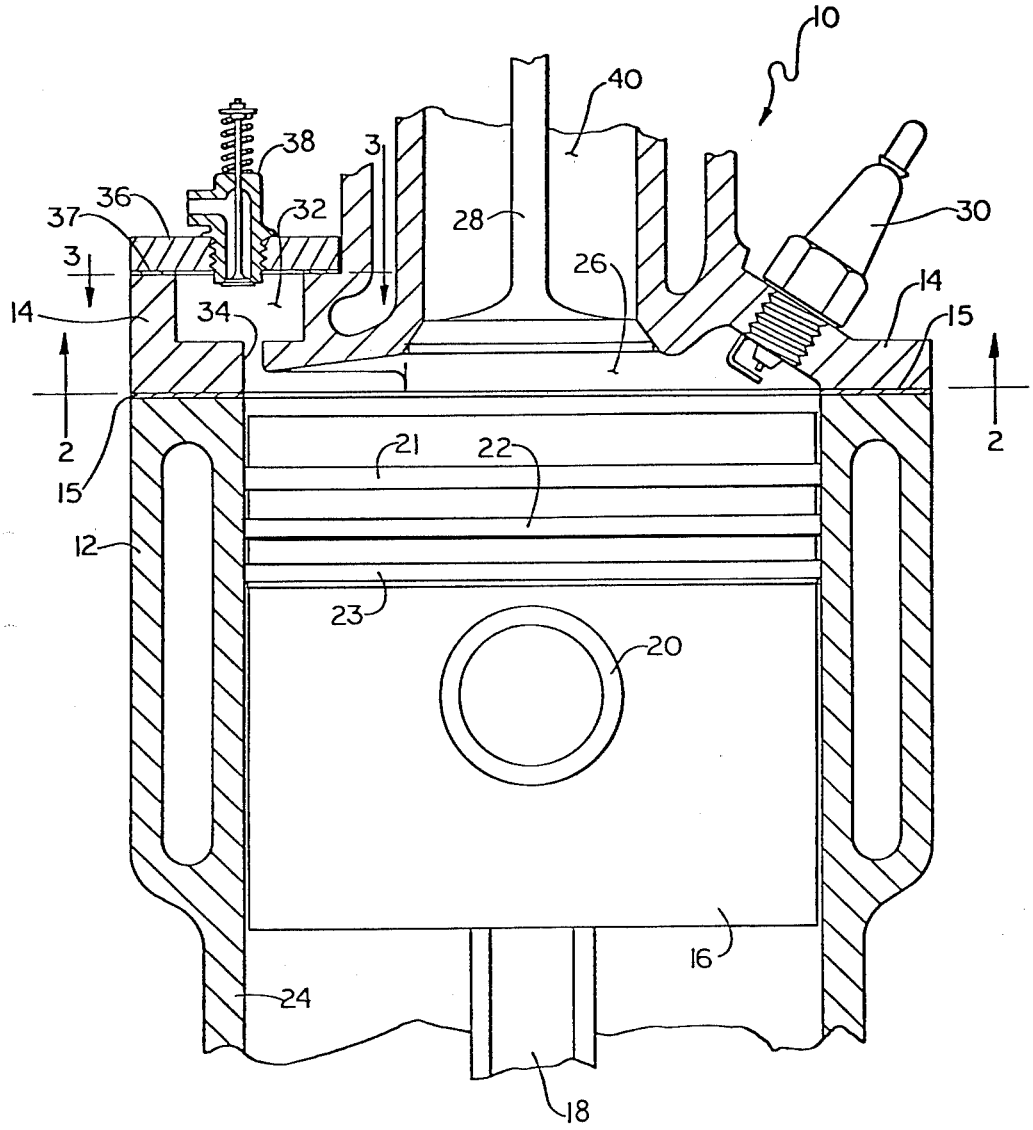

This invention relates to an internal combustion engine having reduced emissions of nitrogen oxides. This application is a continuation-in-part of my application Ser. No. 927,214, filed July 24, 1978, and now U.S. Pat. No. 4,167,930 assigned to Avco Corporation, assignee of the present invention.

Much has been done in recent years to reduce the harmful products of combustion. The Environmental protection Agency publication No. EPA-460/3-76-022 titled, "Nitrogen Oxide Control with the Delayed-Mixing, Stratified-Charge Engine Concept", authored by L. W. Evers, P. S. Myers and O. A. Uyehara present many of the methods that have been explored for controlling nitrogen oxide emissions.

Catalytic converters and other types of thermal reactors have been added to existing engines to reduce the harmful content of emissions after they leave the combustion chamber.

The U.S. Department of Commerce publication number DOT-TSC-OST-75-56 titled, "Stratified Charge Engines" authored by Eric M. Withjack describes the operation of two open chamber stratified charge engines. One is the Ford Programmed Combustion Process (PROCO) engine. The other is the Texaco Controlled Combustion System (TCCS) engine.

The U.S. patents to Goto (U.S. Pat. No. 3,987,776), Winkler (U.S. Pat. No. 3,658,046) and Blaser (U.S. Pat. No. 4,060,059) disclose internal combustion engines which achieve fuel mixture separation within the combustion chamber into rich and lean zones. Goto does this by successively supplying air and a fuel rich mixture by the same path. Winkler achieves a varying degree of fuel richness by centrifugal action. Blaser adds additional air to the combustion chamber so that the gas layer immediately above the piston head is fuel lean when the piston is at bottom-dead-center on the intake stroke. Subsequent engine work by Blaser after the filing of the application which issued as U.S. Pat. No. 4,060,059 is described in U.S. Naval Academy publication Number EW 8-76 titled, "The Naval Academy Heat Balanced Engine (NAHBE)", authored by R. Blaser, A. Pouring, B. Rankin and E. Keating, dated June 1976.

My invention differs from all of the above described engines. With my engine, the air-to-fuel ratio within the cylinder is progressively leaned out during the power stroke portion of the cycle. At ignition the air-to-fuel ratio in the main combustion chamber is preset to be on the fuel rich side. With the build up of combustion chamber pressure, as the flame front progresses across the chamber, additional fuel-lean air is added to the main chamber. This cools the flame, reduces formation of nitric and nitrous oxides and at the same time allows the combustion process to be carried to completion, thereby also reducing formation of both carbon monoxide and hydrocarbons.

Propagational velocity and the acoustic phenomena related to ignition of the fuel charge in an engine chamber is described in detail in U.S. Pat. No. 2,573,536 to Bodine. Bodine teaches means for dampening out acoustic waves which tend to cause the phenomena known as detonation within a combustion chamber. My invention uses the energy contained in the shock wave that flows outward from the point of ignition within the combustion chamber. The energy is used to cyclically pump the contents of the Helmholtz cavity out into the main chamber. Bodine sized his resonator cavities (See columns 8, lines 49–75 and column 9, lines 1–29) so that the reflected acoustic energy from the resonator cavities served to dampen out the wave energy in the main chamber as soon as possible. His goal was to prevent detonation. My goal differs in that I want to use the shock wave energy to pump the pressurized contents of the Helmholtz cavity into the main combustion chamber. However, I want this pumping action to occur over a period of time and without creating damaging detonation conditions in the cylinder chamber.

SUMMARY OF THE INVENTION

My invention pertains to an internal combustion engine wherein the fuel-air mixture within the cylinder is progressively changed during the power stroke portion of the cycle. This progressive change from a fuel-rich to a fuel-lean condition is achieved by means of a Helmholtz resonator cavity placed in the head or closed end of the combustion chamber. The Helmholtz resonator cavity communicates with the combustion chamber through a narrow slit made between the cavity and the chamber. Conditions are maintained so that the flame does not propagate beyond the slit and into the Helmholtz cavity.

At the beginning of the intake stroke in the preferred embodiment, air is introduced into the resonator. Meanwhile, a somewhat rich air-fuel mixture is fed into the main combustion chamber via the intake manifold and the open intake valve. During the compression stroke, some of the rich air-fuel mixture is forced into the resonator cavity via the communicating slot. The air in the resonator, on mixing with the incoming rich air-fuel mixture causes it to become more lean.

When the sparkplug ignites the rich fuel-air mixture in the main chamber at or near the end of the compression stroke, a flame front progresses across the combustion chamber. On reaching the communicating slot between the combustion chamber and the Helmholtz resonator, the flame will not propagate through the slot. Rather, the flame is quenched at the slot and only the pressure wave enters. The pressure wave, caused by the exothermic reaction of the combustion process, enters the slot causing a resonant reaction within the Helmholtz cavity. The cyclic phenomena associated with this resonance serves to transfer the lean fuel-air mixture from the resonator cavity into the main combustion chamber. The cyclic frequency of this pumping action is determined by the geometry of the resonator and the dimensional characteristics of the slot.

As more and more of the lean air-fuel mixture is brought from the resonator into the main chamber, two things are achieved. First, there is a spreading of the combustion process over a longer period of time. This reduces the maximum temperature reached during combustion, thereby reducing formation of nitric and nitrous oxides. Second, the addition of the lean air-fuel mixture allows the combustion process to be carried to completion, thereby reducing formation of both carbon monoxide and hydrocarbons.

have enough area to allow gases to flow from the main chamber into the resonator cavity at pressures reaching no more than 120 psia.

Figure 3:
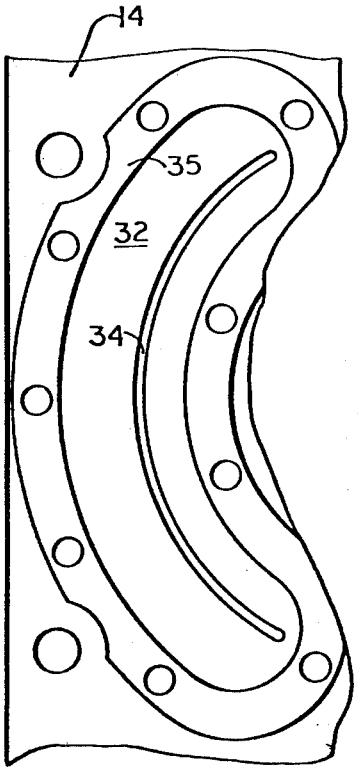
Figure 4:
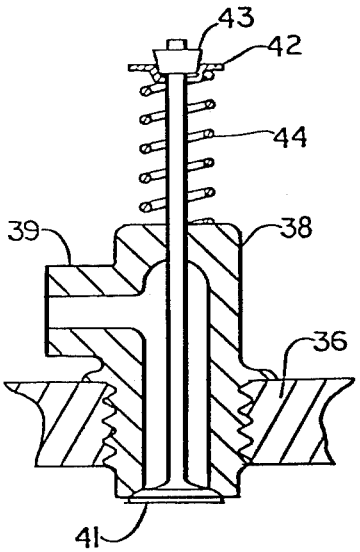

Functionally, slot 34 performs according to the same principles as the resonant iris of a wave guide (See for example, G. C. Southworth's, *Principles and Applications of Wave Guide Transmission,* published by D. Van Nostrand Company, Inc., New York, p. 254). Using analogous wave guide theory, the length of slot 34 (See FIG. 3) is slightly more than one wavelength long. Length in wavelengths is determined using the sound wave velocity of 3000 ft/sec presented at line 68, Column 8 of Bodine (U.S. Pat. No. 2,573,536). Using a velocity of 3000 ft/sec and a resonant frequency of 8000 cps one can determine that the wavelength is 4.5 inches. By analogous wave guide theory the desired length of slot 34 will fall in half wavelengths or multiples thereof.

As regards the depth of slot 34, analogous wave guide theory shows that the iris thickness in wavelengths can be as small as 0.05 while still maintaining low leakage into a match terminated branch (In this implementation, the Helmholtz cavity). Using this information then, the depth of slot 34 can be sized to be somewhere between 0.20 and 0.25 inches for satisfactory performance.

As the shock wave producing flame front reaches slot 34, the pressure wave enters and proceeds across the width of the cavity. At the back thereof it is reflected so that it again crosses the cavity and exits through the slot. Bodine sought to have the exit wave be 180 degrees out of phase with the cyclic valve of the wave in the main chamber. The out of phase condition serves to quickly dampen out the detonation wave. With my invention, there is a need to continue to have the cyclic wave continue until all of the lean mixture has been pumped out of the Helmholtz cavity. For this reason, the depth of the cavity is sized so that the phase of the reflected wave exiting from slot 34 will present a reflective impedance which dampens out the wave in the main chamber in a controlled manner. The depth of cavity 32 depicted in the preferred embodiment of FIG. 1 was chosen to be approximately one eighth wavelength deep.

Other engine configurations could incorporate my invention. The L-head engine would readily lend itself to incorporation of a Helmholtz resonator in the cylinder head. Coolant circulated around the resonator chamber will prevent the edges of the communicating slot from burning.

For an air-cooled engine, the Helmholtz resonator could encircle the top of the cylinder wall. Access to the resonator could be gained along a circumferential slit at the top of the cylinder. The size of the resonator chamber and the dimensions of the slit will be a function of the design speed of the engine, the octane rating of the fuel and the compression ratio. Use of a supercharger on the engine would necessitate use of pressurized air to fill the resonator cavity.

The Helmholtz resonator chamber will also function as a power stroke extender for a fuel injection type engine. The fuel injection engine simplifies the filling of the resonant chamber adjacent the main combustion chamber in that the intake stroke of the piston causes the entire chamber to be filled with air. Hence, no external source of air is needed to fill the Helmholtz resonator and it can be closed except for the communicating slot with the main combustion chamber. The report titled, *Charge Stratification by Fuel Injection Into Swirling Air,* authored by Hussman A. W., Kahoun F. and Taylor R. A., which appeared in SAE Transactions, Vol. 71, 1963, pages 421–444 describes mixture profiles for various fuel injection engines of the prior art. Addition of my invention to these prior art fuel injection engines would enchance their performance, particularly as regards emission of undesired products of combustion.

To summarize, the engine which I have invented incorporates the transfer of a lean air-fuel mixture from a resonator cavity to the main combustion chamber at an intermediate point of the power stroke in response to a cyclic pressure wave condition within the resonator cavity. This cyclic wave condition continues as the size of the main combustion chamber expands following ignition of the air-fuel charge within the cylinder. Transfer of the lean air-fuel mixture to the main chamber from the resonator cavity via the communicating slot brings about a second phase of combustion over a period of time allowing unburned fuel particles to be consumed while at the same time keeping the peak flame temperature to a level where NOX gas production is minimized.

Figure 2:
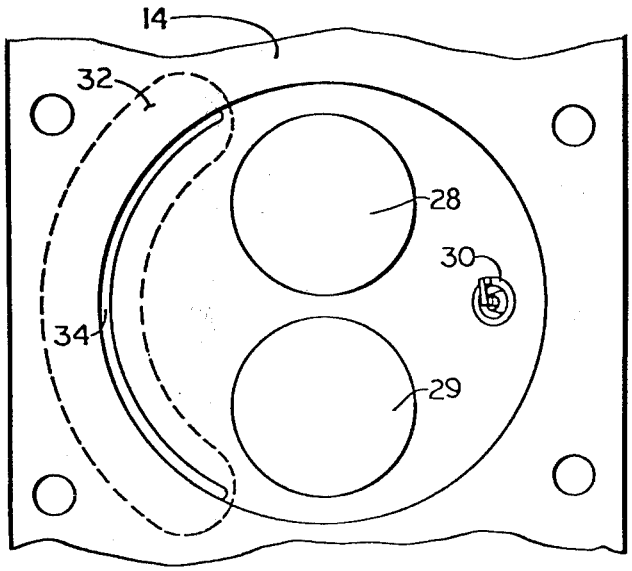

Positioning of the slot which allows the resonator cavity to communicate with the main chamber is important. Optimally, the slot should be located along an arc wherein the wave front of the advancing flame is at a constant pressure. For a hemispherical combustion chamber this would be along an arc of constant radius with respect to the center of the piston. (This is exemplified in the FIG. 2 implementation). For an L-head engine, the slot might optimally have some other configuration. Shaping the piston head crown could also influence the results.

It is to be understood that in some implementations it may be necessary to utilize more than one Helmholtz resonator cavity per cylinder. This need can occur where the intake and exhaust valve ports when combined with the cylinder head configuration preclude room for a single resonant cavity of sufficient volume to do the required task. For these cases a pair of smaller symmetrically arranged cavities can be used. Even more than two might be required in some implementations. The most important criteria to be considered when adding cavities is that the acoustic frequency of the entire assembly must be such that the output from one cavity does not serve to dampen the pumping action of its companions. Additionally, the length of each slot which allows communication between a Helmholtz cavity and the main chamber should be at least a half wave length long, said wave length being computed using the sound wave velocity of the heated gases in the main chamber.

I claim:

1. In combination with a four stroke cycle internal combustion engine wherein there is included a cylinder block having at least one cylinder, a piston in the cylinder with a reciprocating stroke volume of predetermined size, a cylinder head formed to provide a main combustion chamber closed at one end and opening into the stroke volume of the cylinder at the other end, means for supplying a fuel-rich mixture to the main combustion chamber during the intake stroke of the piston, said intake stroke followed by a compression stroke wherein the piston moves to minimize the volume in the main combustion chamber compressing the fuel-rich mixture, means for igniting the fuel-rich mixture near the top dead center position of the piston to bring about a power stroke preceded by a flame front propagation across the main chamber from an ignition point, means for purging the main combustion chamber through an exhaust port during the exhaust stroke of the piston, the improvement which comprises:

a Helmholtz resonator cavity of invariable volume in communication with the main combustion chamber of said cylinder via a constricted slot, said slot defined by an opening into said combustion chamber and a lip from the opening into said cavity, said slot being small enough in width so that the flame in the main combustion chamber is quenched in the opening, said slot being at least a half wavelength long and providing a cross-sectional area large enough to permit the free flow of gas between the main combustion chamber and the cavity without a pressure drop at the conclusion of the compression stroke, the depth of the lip being sized in fractions of the wavelength of the propagation velocity of said flame front, the depth of said resonator cavity being sized in multiples or fractions of a wavelength to provide substantially other than 180 degrees of phase difference between the entering wave and the reflected wave; and means for supplying air to said resonator cavity during the intake stroke of the piston.

2. A combination as described in claim 1 where the igniting means is the spark plug and the depth of the lip is less than 0.1 times the wavelength of the flame propagation frequency.

3. The invention as described in claim 2 wherein the depth of the resonator cavity is sized to be one eighth wavelength thereby providing 90 degrees of phase difference between the entering wave and the reflected wave.

4. A combination as described in claim 1 wherein the entire length of said slot is subjected to substantially constant pressure from said pressure wave front immediately after ignition of said fuel-rich mixture in said main chamber.

5. A combination as described in claim 1 where said cylinder head is spherical and said slot is arcuate having its center line along an arc of equal radius with respect to said ignition point.

6. In combination with a four stroke cycle internal combustion engine wherein there is included a cylinder block having at least one cylinder, a piston in the cylinder with a reciprocating stroke volume of predetermined size, a cylinder head formed to provide a main combustion chamber closed at one end and opening into the stroke volume of the cylinder at the other end, means for supplying an air charge to the main combustion chamber during the intake stroke of the piston, means for injecting a metered quantity of fuel into the air charge within the main combustion chamber, said intake stroke followed by a compression stroke wherein the piston moves to minimize the volume in the main combustion chamber compressing the charge, means for igniting the fuel-air mixture near the top dead center position of the piston to bring about a power stroke preceded by a flame front propagation across the main chamber from an ignition point, means for purging the main combustion chamber through an exhaust port during the exhaust stroke of the piston, the improvement which comprises:

a Helmholtz resonator cavity of invariable volume in communication with the main combustion chamber of said cylinder via a constricted slot, said slot defined by an opening into said combustion chamber and a lip from the opening into said cavity, said slot being small enough in width so that the flame in the main combustion chamber is quenched in the opening, said slot being at least a half wavelength long and providing a cross-sectional area large enough to permit the free flow of gas between the main combustion chamber and the cavity without a substantial pressure difference remaining at the conclusion of the compression stroke, the depth of the lip being sized in fractions of the wavelength of the propagation velocity of said flame front, the depth of said resonator cavity being sized in multiples of fractions of a wavelength to provide substantially other than 180 degrees of phase difference between the entering wave and the reflected wave.

7. The invention as described in claim 6 where the igniting means is the spark plug and the depth of the lip is less than 0.1 times the wavelength of the flame propagation frequency.

8. A combination as described in claim 7 wherein the entire length of said slot is subjected to substantially constant pressure from said pressure wave front immediately after ignition of the fuel-air charge in said main combustion chamber.

* * * * *

UNITED STATES PATENT AND TRADEMARK OFFICE

CERTIFICATE OF CORRECTION

PATENT NO. : 4,221,198

DATED : September 9, 1980

INVENTOR(S) : Robert J. McNair, Jr.

It is certified that error appears in the above-identified patent and that said Letters Patent are hereby corrected as shown below:

Col. 4, line 36, "ensuring" should read -- ensuing -- .

Col. 5, line 30, "valve" should read -- value -- .

Signed and Sealed this

*Sixteenth* Day of *December 1980*

[SEAL]

*Attest:*

SIDNEY A. DIAMOND

*Attesting Officer*

*Commissioner of Patents and Trademarks*